US006219988B1

(12) United States Patent
Mahfouz et al.

(10) Patent No.: US 6,219,988 B1
(45) Date of Patent: Apr. 24, 2001

(54) WRAPPING SYSTEM FOR STRENGTHENING STRUCTURAL COLUMNS OR WALLS

(75) Inventors: Ibrahim Mahfouz, Heliopolis (EG); Shahram Sarkani, Potomac, MD (US); Tarek Rizk, Cairo (EG)

(73) Assignee: The George Washington University, Washington, DC (US)

( * ) Notice: Subject to any disclaimer, the term of this patent is extended or adjusted under 35 U.S.C. 154(b) by 0 days.

(21) Appl. No.: 09/270,836

(22) Filed: Mar. 18, 1999

(51) Int. Cl.[7] ..... E04C 3/34

(52) U.S. Cl. ..... 52/721.4; 52/723.1; 52/724.1; 52/736.3; 52/737.4

(58) Field of Search ..... 52/514.5, 515, 52/516, 249, 720.1, 721.4, 723.1, 724.1, 736.3, 737.4; 156/71

(56) References Cited

U.S. PATENT DOCUMENTS 2,358,758 * 9/1944 Eames ..... 52/786.13
2,924,546 * 2/1960 Shaw ..... 156/71
3,793,104 * 2/1974 Harrowing ..... 156/94
4,543,764 * 10/1985 Kozikowski ..... 52/746.1
4,786,341 * 11/1988 Kobatake ..... 52/167.1
5,043,033 * 8/1991 Fyfe ..... 52/223.1
5,218,810 * 6/1993 Isley ..... 52/725
5,657,595 * 8/1997 Fyfe ..... 52/252
5,924,262 * 7/1999 Fawley ..... 52/721.4
5,946,880 * 9/1999 Morrison ..... 52/737.1

* cited by examiner

*Primary Examiner*—Beth A. Stephan
(74) *Attorney, Agent, or Firm*—Finnegan, Henderson, Farabow, Garrett & Dunner, L.L.P.

(57) ABSTRACT

A method of reinforcing a substantially vertical support structure comprising the steps of: wrapping at least one sheet of resin impregnated high strength fiber around the support structure to form a multi-layer wrap, and then interposing a substantially stiff inner element between layers in the multi-layer wrap prior to completing the wrapping step, thereby sandwiching the substantially stiff inner element within the multi-layer wrap. The invention further includes a support structure comprising: a substantially vertical support, layers of resin impregnated high strength fiber tightly wrapped around a peripheral portion of the vertical support, and at least one stiff inner element interposed within the layers and substantially covering the vertical support.

8 Claims, 6 Drawing Sheets

WRAPPING SYSTEM FOR STRENGTHENING STRUCTURAL COLUMNS OR WALLS

BACKGROUND OF THE INVENTION

1. Field of the Invention

The present invention relates to the field of structural engineering and, more particularly, reinforced concrete based structures, such as columns and walls, and wrapping methods and mechanisms for strengthening such structures. More specifically, the invention pertains to a wrapped structure and wrapping process for improving the structure's axial, flexural, and shear strength, as well as its ductility and stiffness.

2. Description of the Related Art

Conventional techniques for wrapping columns or walls involve winding fabric made of filament or fiber around at least a portion of the structure. The fiber fabric typically is made of glass fiber, carbon fiber, or aramids fiber. The amount of fiber wrapping applied to a column or wall depends upon the type and degree of strengthening that the specific structure requires.

Thin filament or fiber fabric wrapping, referred to hereinafter as fiber reinforced plastic (FRP) wrapping, is known in the art and described generally in U.S. Pat. No. 5,218,810, which is hereby incorporated by reference. When a circular column has FRP wrapping wound around it, the wrapping exerts a substantially uniform confining pressure around the entire circumference of the column because of the circumferential membrane (axial) stiffness of the wrapping system. As a result, the FRP confines the entire cross-section of the wrapped structure.

Conventional methodologies of applying FRP wrapping have been successful in improving the strength and ductility of circular columns. Considerations applicable to noncircular columns and walls, however, are different. This is because the axial stiffness of the filament or fiber winding in the transverse direction of the column or wall (i.e., in a direction perpendicular to the axis of the column or wall) cannot provide any significant confinement along the flat sides or planar surfaces of the noncircular structure. As such, most of the confining pressure falls on the corners of the column or wall. Thin FRP wrapping possesses negligible transverse flexural stiffness and, therefore, considerable portions of the noncircular cross-section remain unconfined. Significantly, most columns or walls are noncircular. Accordingly, there is a need for a wrapping system that is adaptable to all types of columns or walls.

SUMMARY OF THE INVENTION

To overcome the disadvantages of the prior art, and in accordance with the purposes of the invention, as embodied and broadly described herein, there is provided a method for strengthening an existing structure, such as a column or wall, comprising winding a sheet of resin impregnated fiber around a concrete structural member to form a multi-layer wrap and interposing a substantially stiff inner element between layers of the wrap prior to completing the winding step, thereby sandwiching the substantially stiff inner element within the wrap. The structure usually is made of concrete or cement, but also may include brick and cinder block among others, all of which are referred to herein as masonry.

Also in accordance with the purposes of the invention, as embodied and broadly described herein, there is provided a reinforced support structure comprising a masonry column or wall, layers of resin impregnated fiber tightly wrapped around a peripheral portion of the masonry column or wall, and stiffening means either interposed within the layers along the wall or disposed immediately adjacent the column or wall.

Preferably, the stiffening means includes one or more stiff inner elements substantially enveloping the exterior of the support structure. If the support structure is noncircular, the stiffening means may include one or more planar stiff inner elements arranged along each side of the support structure. Alternatively, if the support structure is substantially circular, the stiffening means may be shaped or configured to conform to the exterior of the support structure.

In addition, it is preferable if the stiffening means is formed from a substantially lightweight material having a high ratio of strength to weight and a high ratio of stiffness to weight. In a preferred embodiment, the stiffening means includes a plurality of planar support members which substantially encapsulate the column or wall, when assembled.

BRIEF DESCRIPTION OF THE DRAWINGS

The accompanying drawings, which are incorporated in and constitute part of the specification, illustrate presently preferred embodiments of the invention and, together with the general description given above and detailed description of the preferred embodiment given below, serve to explain the principles of the invention.

DESCRIPTION OF THE PREFERRED EMBODIMENTS

Figure 1:
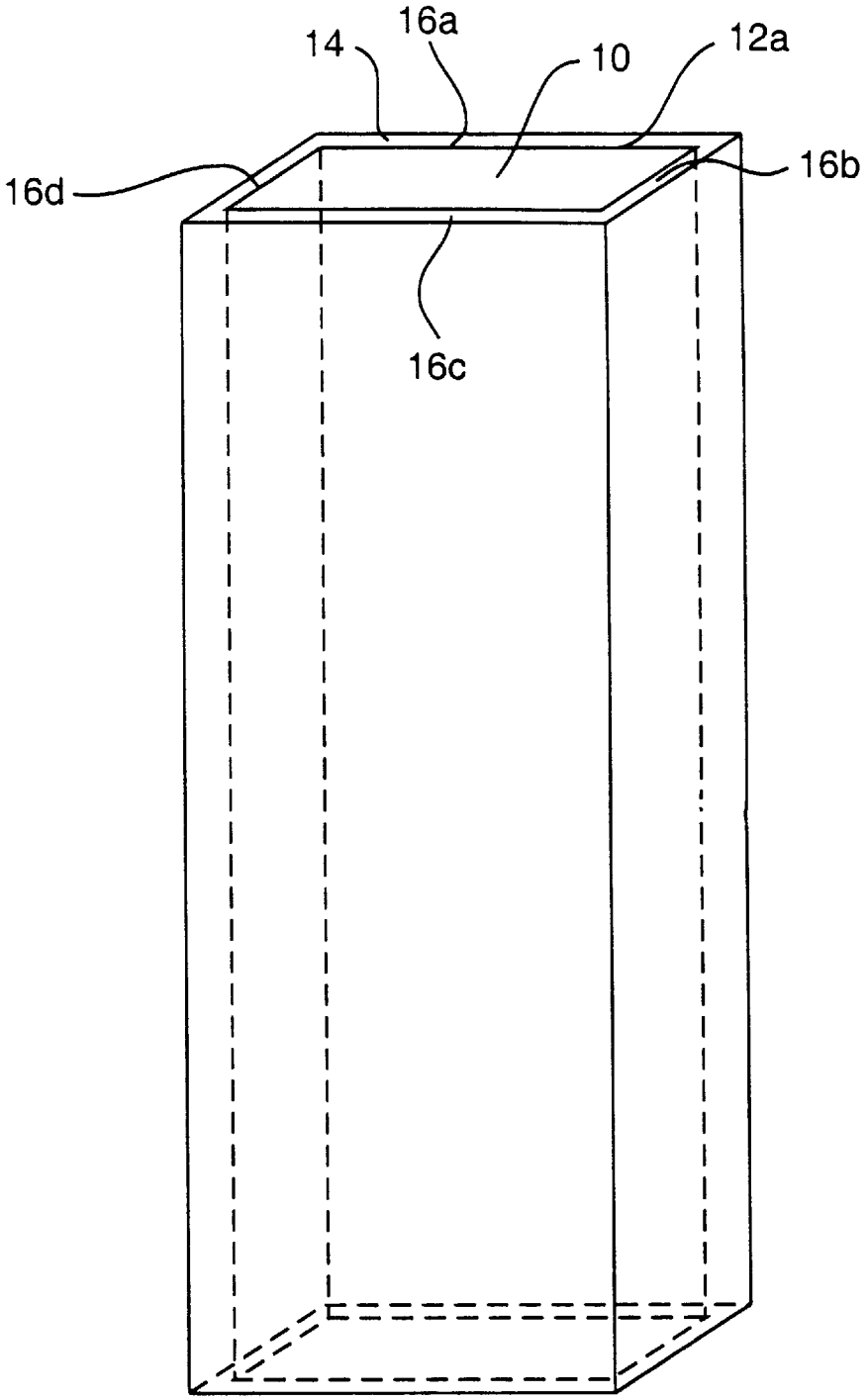
FIG. 1 is a perspective view of one embodiment of the present invention (the outer wrap not shown).

Reference will now be made in detail to present preferred embodiments of the invention as illustrated in the accompanying drawings.

Buildings are formed of stress bearing vertical or upright support structures, such as columns or walls, which are generally identified in the drawings by reference numeral 10. As shown in FIGS. 1–6, reinforcement of the support 10 includes wrapping of one or more sheets of high strength material around the support 10, e.g. the wrap. The sheets form layers which are designated 12*a*, 12*b*, etc. Preferably, the wrap is a relatively thin FRP material which has been impregnated with resin, such as epoxy polyester, or vinyl ester resin, prior to wrapping.

Figure 2:
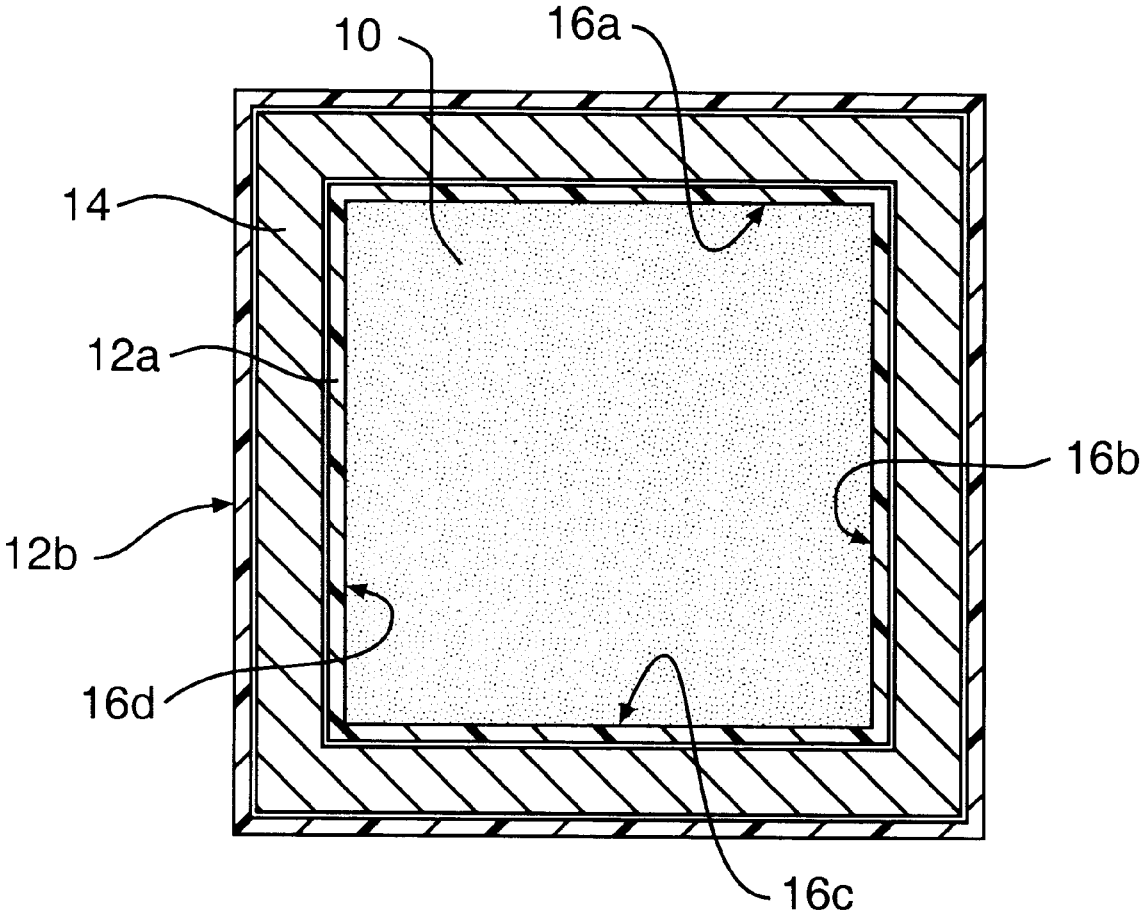
FIG. 2 is a top plan view of the embodiment shown in FIG. 1 showing the inner and outer wraps.
Figure 3:
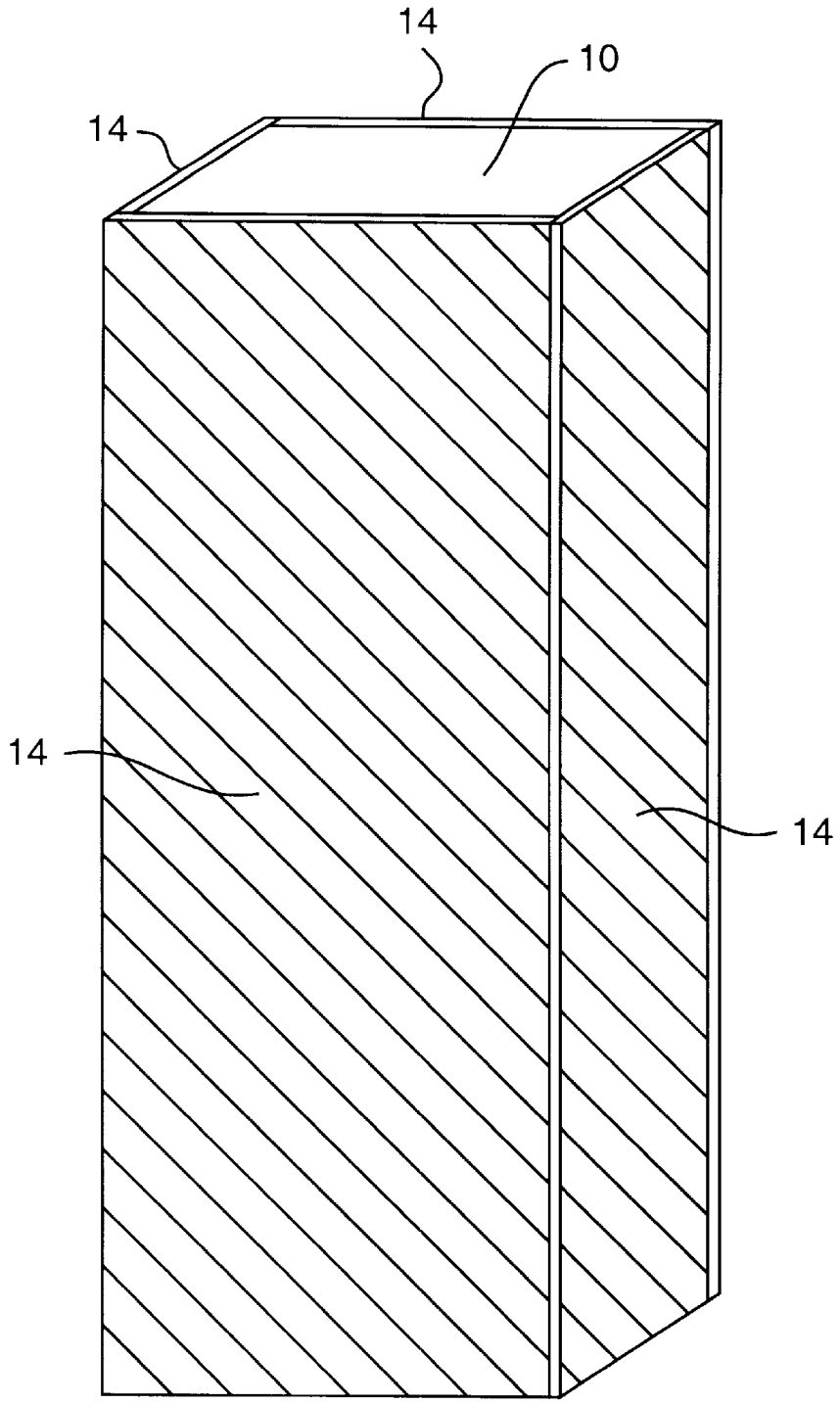
FIG. 3 is a perspective view of another embodiment of the present invention (the outer wrap not visible).
Figure 4:
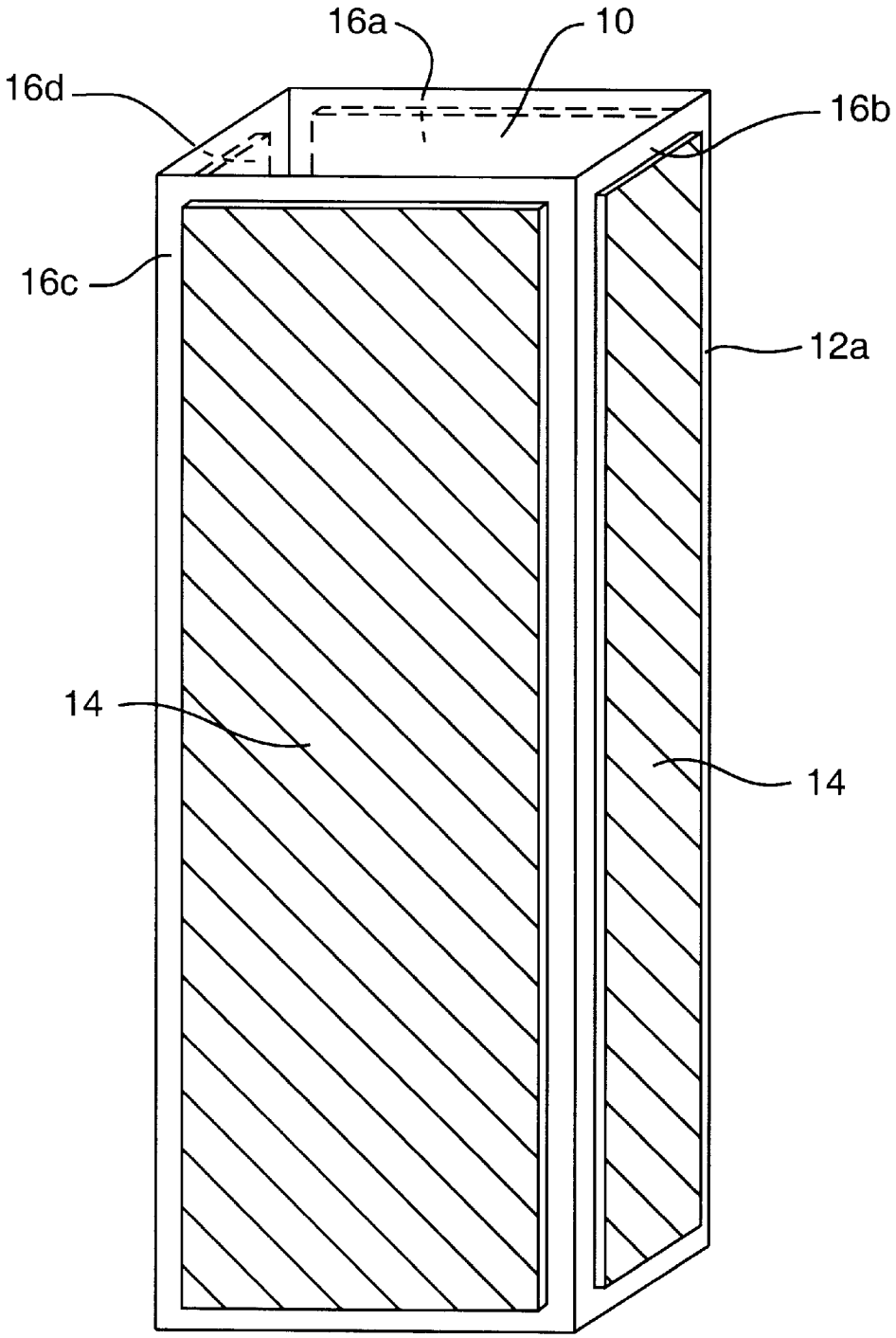
FIG. 4 is a perspective view of another embodiment of the present invention (the outer wrap not shown).
Figure 5:
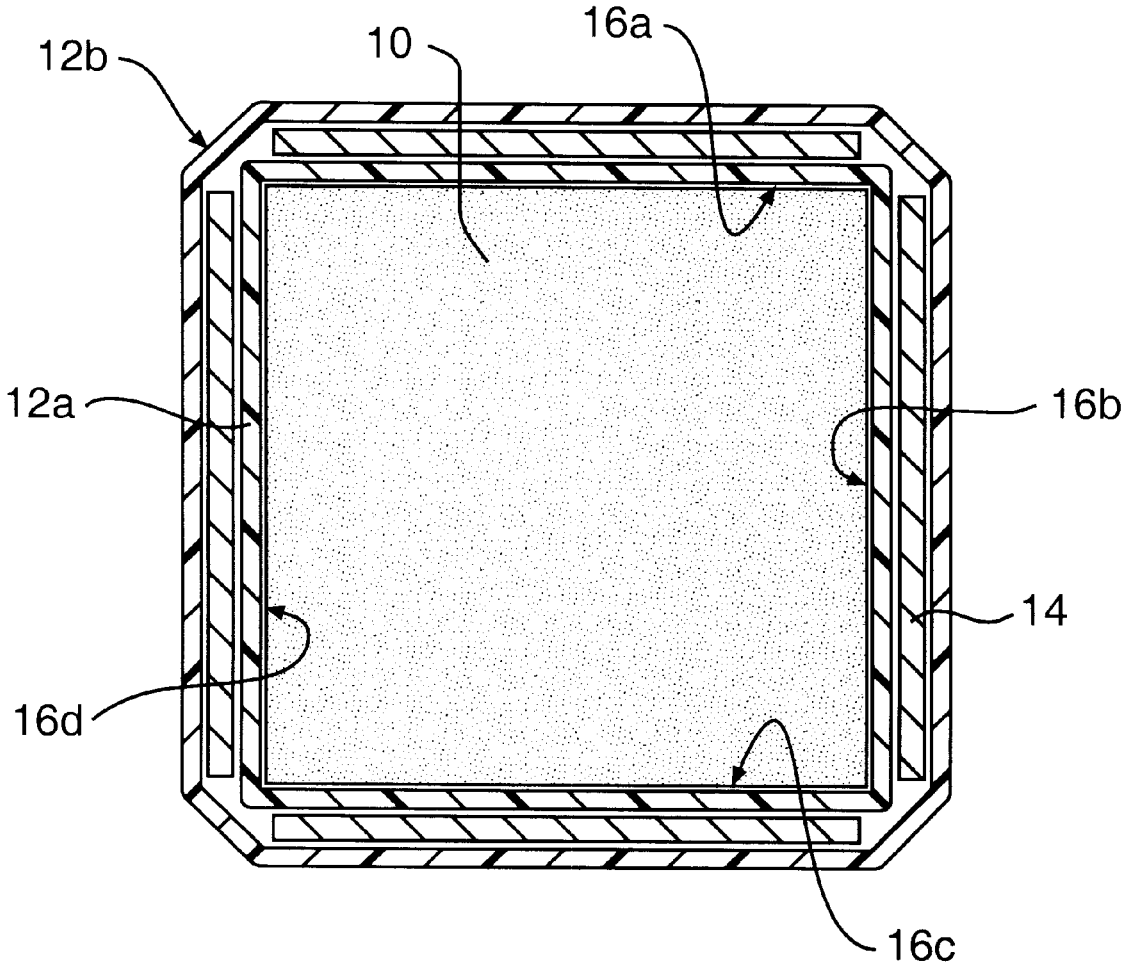
FIG. 5 is a top plan view of the embodiment of the present invention shown in FIG. 4 with the inner and outer wraps.
Figure 6:
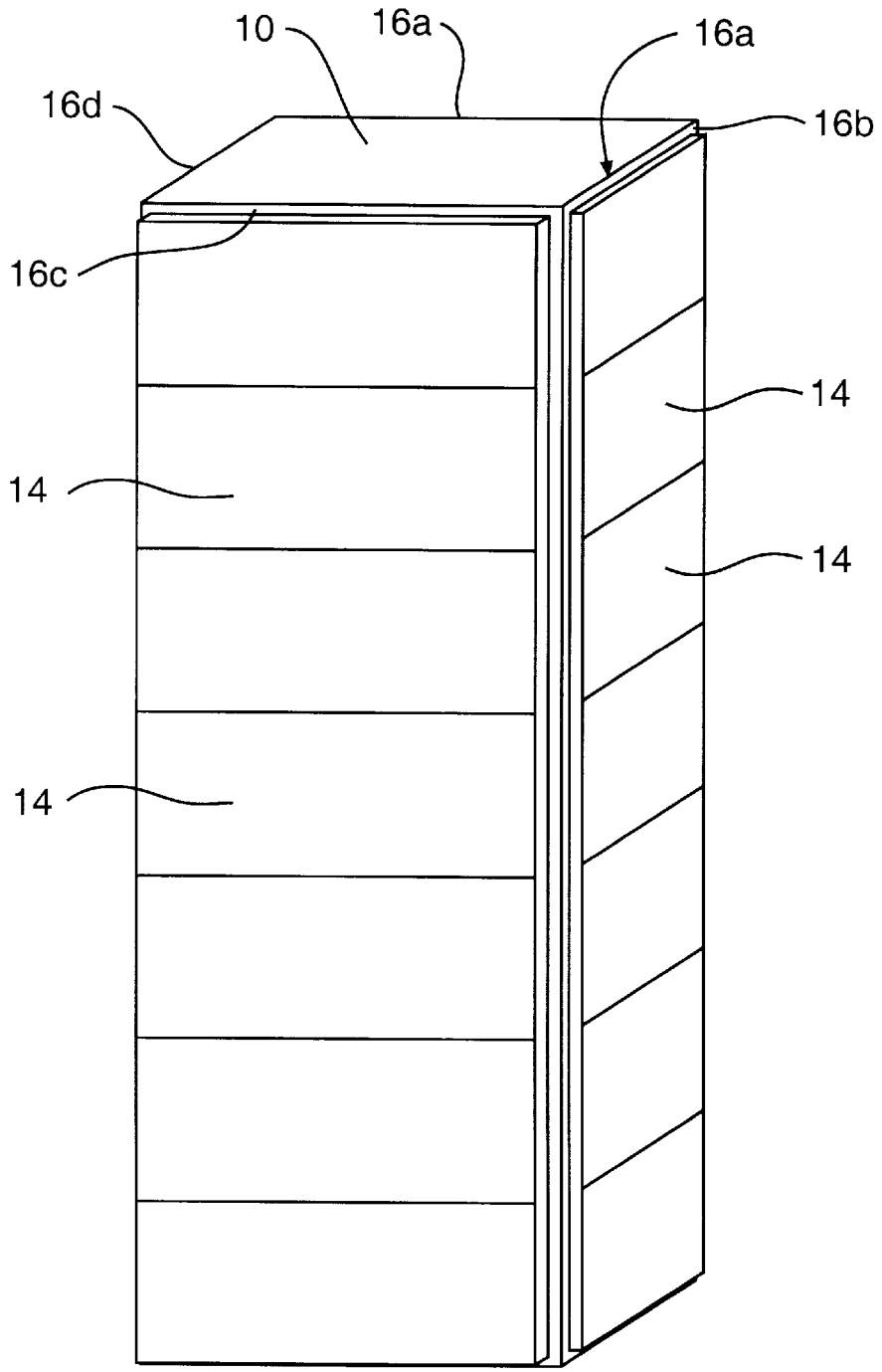
FIG. 6 is a perspective view of still another embodiment of the present invention that also does not include the outer wrap in order to show the stiff members arranged along sides of the column.

In accordance with the present invention, there is provided stiffening means used in combination with the wrap. As embodied herein and shown principally in FIGS. 2–6, the stiffening means preferably includes one or more substantially stiff inner elements 14 interposed between layers of the wrap to form a sandwich wrap configuration having an inner wrap 12*a* and outer wrap 12*b*, for example. Alternatively, the stiff inner element 14 may be positioned immediately adjacent the support 10. It is desirable for the wrap to be wound tightly around the support 10 to urge the stiff inner element (s) 14 toward the support 10. As shown in FIG. 3, several stiff inner elements 14 may be used on each side of the support 10. To provide sufficient strength along the support 10, the stiff inner elements 14 preferably are arranged along a substantial length of each side 1 6a-d of the support 10.

It is understood that the support 10 may include any number of sides and that the stiffening means may be shaped to conform to the exterior of the support 10. For example, as shown in FIG. 2, stiff inner elements 14 may be rigidly connected by nails, screws or adhesive, to form an integrally formed box-like configuration around the support 10.

In accordance with the present invention, the stiff inner element 14 should be formed from material which has high compressive strength in the transverse direction and possesses relatively high transverse shear rigidities. In general, lightweight materials are preferable, both statically and dynamically, for applications involving dynamic and seismic loads. It also is preferable for stiff members 14 to be formed from materials with viscoelastic characteristics in order to dampen transient vibrations. Materials which may be used include, but are not limited to, composite materials like honeycomb, wood, medium density fiber, reinforced rubber and various metals, such as titanium.

The effectiveness of the wrapping of the present invention may be enhanced by increasing the thickness of the stiff inner element(s) 14. It also may be improved by wrapping the support so that the FRP fibers of the wrap are placed along the longitudinal direction of the support 10 to increase flexural stiffness of the constraining wrap.

The present invention also includes a method of strengthening or reinforcing an upright or substantially vertical masonry support structure. The method preferably comprises winding a sheet of resin impregnated fiber around an elongate concrete structural member 10 to form a multilayer wrap, and interposing an elongate substantially stiff inner element 14 between layers prior to completing the winding step, thereby sandwiching the support member within the wrap.

It is desirable for the support 10 to have an exterior surface, generally designated 16, which is substantially smooth and free of irregularities, such as pockets or protuberances. It is also preferable that the wrap is wound tightly around the support 10.

FRP wrapping materials are produced in different forms and shapes, including woven fiber composites, tapes, sheets, wires, and thin pultruded plates and pultruded structural shapes. When applying woven fibers, wire, sheets, and tapes to reinforce concrete columns or walls in accordance with the present invention, the following procedure is suitable, but is by no means the only way to achieve the advantages of the present invention.

Prior to wrapping, the surface of the structural element to be repaired may be treated to enhance a complete bond between the structural element and the wrapping material. Preferably, the surface is clean and substantially free of any substance that may adversely affect bonding the wrapping system to the structure. It is also desirable for the surface to be free of irregularities in the form of pockets or protuberances. It also may be advantageous to treat the structure with an adhering compound depending on the resin manufacturer's specifications.

Once the structure 10 is substantially clean and substantially free of irregularities, one or more layers of FRP, preferably saturated with a compatible resin, are wrapped tightly (i.e., with little or no slack) around the column or wall. Suitable FRP's or other materials may include glass, carbon, and aramid fiber reinforced plastics. A compatible resin can be chosen from a variety of resins that have physical properties compatible with those of the fibers and the material of the structural element and that, when combined with the fiber, can produce an element possessing the required mechanical properties for the repair or upgrade of the structure. The most commonly used resins are thermosetting resins including epoxy, polyester, and vinyl ester.

Thereafter, stiff inner element(s) 14 may be bonded to the FRP using the same or functionally similar type of resin used in saturating the FRP. Finally, one or more layers of FRP are wrapped around the outer face of the stiff inner element(s) 14. The main direction of the fibers preferably should follow the perimeter of the column or wall.

The present invention is ideally suited for use on noncircular columns or walls that require repair and rehabilitation because of structural overload, reduced strength, or deterioration of materials. It is also ideally suited for increasing the load-carrying capacity, strength, ductility, and/or stiffness of columns or walls that are subject to increased values of static and dynamic loads. In particular, the method and structure of the present invention significantly increases the likelihood that columns or walls will survive earthquakes and seismic shocks by sustaining their support function during the fluctuating loads brought about by such events.

It will be apparent to those skilled in the art that various modifications and variations can be made in the structure and methodology of the present invention without departing from the spirit and scope of the invention. Thus, it is intended that the present invention cover modifications and variations of this invention provided they come within the scope of the appended claims or their equivalents.

We claim:

1. A wrapping system for improving strength and ductility of non-circular, reinforced masonry columns or beams, comprising:

at least two layers of resin impregnated high strength fiber for being tightly wrapped around the periphery of the columns or beams; and a substantially rigid layer having high compressive strength in a transverse direction with respect to the axis of the columns or beams, the substantially rigid layer providing a plurality of first substantially rigid surfaces adapted to substantially abut a plurality of second surfaces around the columns or beams, the substantially rigid layer being interposed between the at least two layers and substantially enveloping a peripheral portion of the columns or beams when wrapped, so that the wrapping system provides axial and flexural stiffness along the wrapped portion of the columns or beams.

2. The wrapping system as defined in claim 1, wherein the substantially rigid layer is adapted to surround the entire periphery of the columns or beams.

3. The wrapping system as defined in claim 1, wherein two or more of wrapping systems are adapted to be applied to a single column or beam.

4. The wrapping system as defined in claim 1, wherein the at least two layers of resin impregnated high strength fiber are formed of woven sheets of glass fiber reinforced plastic.

5. The wrapping system as defined in claim 1, wherein the substantially rigid layer is selected from a group consisting of honeycomb, wood, medium density fiber, reinforced rubber, and titanium.

6. The wrapping system as defined in claim 1, wherein the resin is selected from a group consisting of epoxy polyester and vinyl ester.

7. The wrapping system as defined in claim 1, wherein the first substantially rigid surfaces have a substantially planar configuration.

8. A method of reinforcing a non-circular structure comprising the steps of:

filling holes and removing protuberances along faces of a vertical concrete structural member to provide a substantially smooth outer surface;

impregnating fiber reinforced plastic sheets with resin;

wrapping at least one of the impregnated sheets around the structural member to provide a wrap of at least one layer of thickness;

arranging substantially rigid planar elements around a peripheral portion of the member along the wrap such that the peripheral portion of the structural member is substantially covered by the substantially rigid planar elements; and wrapping at least one of the impregnated sheets around the planar elements to add at least one more layer of wrap, thereby sandwiching the planar elements within the layers of the wrap to provide axial and flexural stiffness along the warp.

* * * * *

UNITED STATES PATENT AND TRADEMARK OFFICE

CERTIFICATE OF CORRECTION

PATENT NO. : 6,219,988 B1
DATED : April 24, 2001
INVENTOR(S) : Mahfouz et al.

It is certified that error appears in the above-identified patent and that said Letters Patent is hereby corrected as shown below:

Column 6,
Line 7, change "warp" to -- wrap --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*